US006626628B1

(12) United States Patent
Kawai et al.

(10) Patent No.: US 6,626,628 B1
(45) Date of Patent: Sep. 30, 2003

(54) PUSHING DEVICE FOR LARGE SWEEPER

(75) Inventors: Yuzo Kawai, Nara-Ken (JP); Yuji Kawai, Nara-Ken (JP)

(73) Assignee: Suiden Co., Ltd., Nara-ken (JP)

( * ) Notice: Subject to any disclaimer, the term of this patent is extended or adjusted under 35 U.S.C. 154(b) by 0 days.

(21) Appl. No.: 09/704,481

(22) Filed: Nov. 2, 2000

(30) Foreign Application Priority Data

Jul. 17, 2000 (JP) ..... 2000-215497

(51) Int. Cl.[7] ..... B66F 9/14

(52) U.S. Cl. ..... 414/607; 414/619

(58) Field of Search ..... 414/607, 608, 414/619, 917, 662, 663, 667; 187/237, 222

(56) References Cited

U.S. PATENT DOCUMENTS

| | | | | | |
|---|---|---|---|---|---|
| 3,556,328 | A | * | 1/1971 | Miles | 214/620 |
| 3,850,322 | A | * | 11/1974 | Miles et al. | 214/620 |
| 4,239,446 | A | * | 12/1980 | Vucinic | 414/785 |
| 4,708,576 | A | * | 11/1987 | Conley | 414/607 |
| 5,139,385 | A | * | 8/1992 | Chase et al. | 414/667 |
| 6,149,373 | A | * | 11/2000 | Gesuale | 414/607 |

* cited by examiner

*Primary Examiner*—Eileen D. Lillis
*Assistant Examiner*—Charles A. Fox
(74) *Attorney, Agent, or Firm*—Darby & Darby

(57) ABSTRACT

An interface between forks of a fork lift and one or more sweepers includes elements to receive the forks, and forward-facing elements fittable into fork insertion members in the sweepers. The forward-facing elements are spaced far enough apart to permit using more than one sweeper without mutual interface.

4 Claims, 5 Drawing Sheets

PUSHING DEVICE FOR LARGE SWEEPER

BACKGROUND TO THE INVENTION

1. Field of the Invention:

The present invention relates to a device for pushing a large sweeper, particularly, the present invention may be used to push two or more large sweepers with one fork lift.

2. Description of the Related Art:

The applicants for the present invention have previously filed patent number JP2824570(publication no. 09302636) for a large cleaning vehicle, and patent number JP2881576 (publication no. 10060846) for a large-sized scavenging car. Both inventions are conventionally used in sweeping large areas.

Referring to FIG. 4, a conventional large sweeper 3' (large-sized scavenging car in JP2881576, publication no. 10060846) includes a pair of fork insertion members 7, 7 rotatively attached to an upper surface of large sweeper 3'. Fork insertion members 7, 7 are rigidly formed to receive a fork (not shown) extending from a fork lift (not shown) to provide guidance and control to large sweeper 3'. Large sweeper 3' is used by pushing forward with the fork lift(not shown) and is guided in this manner over an area requiring sweeping.

Additionally referring now to FIG. 5, a conventional large sweeper 3 (large cleaning vehicle in JP2824570, publication no. 09302636) includes a fork insertion member 3*a* rotatively attached to an upper surface of large sweeper 3. Fork insertion member 3*a* is rigidly formed to receive a fork (not shown) from a fork lift(not shown) to provided guidance and control to large sweeper 3. Large sweeper 3 is used by pushing forward with the fork lift(not shown) and is guided in this manner over an area requiring sweeping.

Large sweepers 3', 3 are guided and controlled by an operator of a fork lift. The use of a fork lift allows the operator to direct the movement of large sweepers 3', 3 accurately and safely. Conventionally, sweeping is conducted by having one fork lift push one large sweeper 3', 3. In a single sweeping pass, the operator is restricted to sweeping an area the width of large sweeper 3', 3. As a result, while it is possible to sweep a large floor area in this manner, sweeping is more quickly conducted with an even wider sweeper (not shown) or when two or more large sweepers 3', 3 are used in tandem.

However, where a wider sweeper (not shown) is used, larger than conventional large sweepers 3', 3, problems of reduced agility, increased risk of equipment damage, and increasing cost are encountered. Particularly, narrow areas are very difficult to sweep with the wider sweeper(now shown) or cannot be swept by the wider sweeper at all and must be swept by hand. As a result, operational costs may increase. To achieve both increased width of sweeping and retain the ability to sweep narrow areas it is easier to use two or more large sweepers 3', 3 in tandem.

OBJECT AND SUMMARY OF THE INVENTION

It is an object of the present invention to provide an interface pushing device for a large sweeper.

It is an another object of the present invention to provide a pushing device for at least one large, sweeper that can clean a wider range of areas even while using previously: designed large sweepers.

It is an another object of the present invention to provide a pushing device for use with multiple large sweepers thereby enabling a larger surface to be swept in a faster manner.

It is an another object of the present invention to provide a pushing device adaptable for use either with a single large sweeper or with two or more large sweepers used in tandem.

The present invention relates to an interface element for interfacing forks of a fork lift with a fork insertion member of a sweeper to provide guidance and control to the sweeper. The interface element includes a box element, formed for receiving a fork of the fork lift, and a forward-extending element fittable into the fork-insertion member of the sweeper. The forwarding-extending element having a size and a shape substantially the same as a fork of the fork lift to securely guide and control the sweeper.

According to an embodiment of the present invention there is provided an interface element for interfacing forks of a fork lift with a sweeper, the sweeper being of a type having a fork-insertion member for receiving a fork of a fork lift, the interface element comprising: at least one box element on the interface element for receiving a fork of the fork lift; at least one forward-extending element on the interface element; and the forward-extending element having a size and shape substantially the same as the fork of the fork lift, whereby the fork of the fork lift is fittable into the at least one box element, and the at least one forward-extending element is fittable into the fork-insertion member of the sweeper.

According to an embodiment of the present invention there is provided an interface element wherein: the at least one forward-extending element includes at least first and second generally parallel spaced-apart forward-extending elements; the first forward-extending element being fittable into a fork-insertion member of a first sweeper; the second forward-extending element being fittable into a fork-insertion member of a second sweeper; and a spacing between the first and second forward-extending elements being sufficient to permit both the first and the second sweepers to operate substantially without mutual interference.

According to an embodiment of the present invention there is provided an interface element wherein: the box element is a generally rectangular cavity having a first end and a second end; the first end having an opening formed to receive and engage the fork of the fork lift; and the second end having a cover formed to prevent passage of the fork away from the box element.

According to an embodiment of the present invention there is provided an interface element wherein: the box element has a first and a second surface; the first and the second surface formed for guiding and controlling the fork of the fork lift; the box element having at least one internal partition; the at least one internal partition formed between the first and the second surfaces; and the at least internal partition guiding and controlling the fork between the first and the second surfaces.

According to an embodiment of the present invention there is provided an interface element wherein: the at least one forward-extending element includes at least a first and a second and a third and a fourth generally parallel spaced-apart forward-extending elements; the first and the second forward-extending elements being fittable into a fork-insertion member of a first sweeper; the third and the fourth forward-extending elements being fittable into a fork insertion member of a second sweeper; and a spacing between the first and the second and the third and the fourth forward-extending elements being sufficient to permit both the first and the second sweepers to operate substantially without mutual interference.

According to another embodiment, the present invention relates to a pushing device for a sweeper, the sweeper being of a type having a fork-insertion member for receiving a fork of a fork lift, the pushing device for the sweeper comprising: a box element formed to guidably receive the fork from the fork lift; a horizontal element; the box element affixed to the horizontal element and extending away from the horizontal element; a plurality of insertion members extending from the horizontal element generally perpendicular to the box element; and each the insertion member being fittable into at least one fork insertion member provided on an external sweeper.

The above, and other objects, features and advantages of the present invention will become apparent from the following description read in conjunction with the accompanying drawings, in which like reference numerals designate the same elements

DESCRIPTION OF THE PREFERRED EMBODIMENTS

Figure 1:
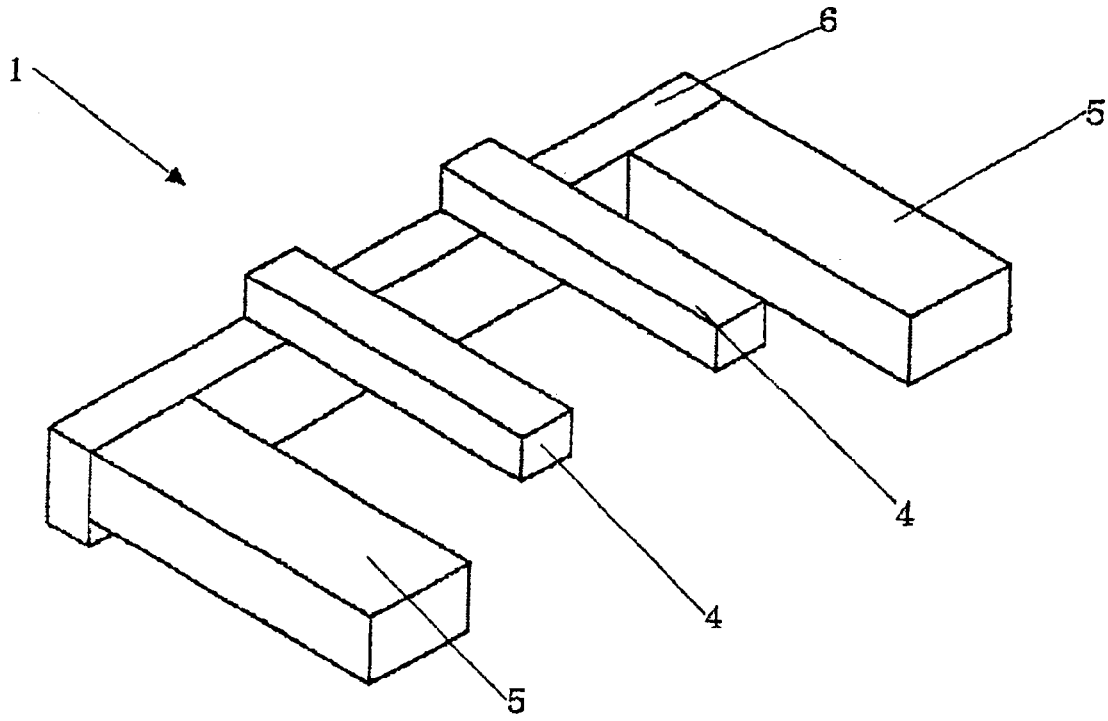
FIG. 1 is a perspective view showing a first embodiment of the present invention.

Referring to FIG. 1, a first embodiment of a pushing device 1, for a sweeper (not shown), includes two body boxes 4,4, each formed as a rigid cavity having four sides and a front and a rear side. The four sides of body boxes 4,4 include a left, a right, a top and a bottom surface each created from a substantially rigid material. The front and rear sides of body boxes 4, 4 are formed to allow access to an interior of each body box 4, 4. Body boxes 4,4 are shaped to receive and secure forks 2*a*, 2*a*(not shown) extending from a fork lift 2(not shown), as will be explained.

Extending parallel to the bottom surface of body boxes 4,4 is a horizontal board 6. Horizontal board 6 is affixed to body boxes 4,4 and extends away from the respective left and the right surfaces of body boxes 4,4.

In the first embodiment of pushing device 1, body boxes 4,4 extend perpendicular from horizontal board 6, and are affixed to horizontal board 6 at points equally distant from a central portion of horizontal board 6. Body boxes 4, 4 are positioned to receive forks 2*a* (not shown) extending from fork lift 2(not shown) thereby enabling control of horizontal board 6.

Two insertion members 5,5 extend away from horizontal member 6 parallel to body boxes 4,4. Insertion members 5,5 are generally parallel to body boxes 4,4, and are formed to fit within a fork insertion member 3a(not shown), as will be described. Additionally, while the first embodiment of pushing device 1, is shown with two separate body boxes 4, 4 and two separate insertion members 5,5, pushing device 1 may be alternatively formed with singular or additional multiples of body box 4 depending upon customer demand.

Figure 2:
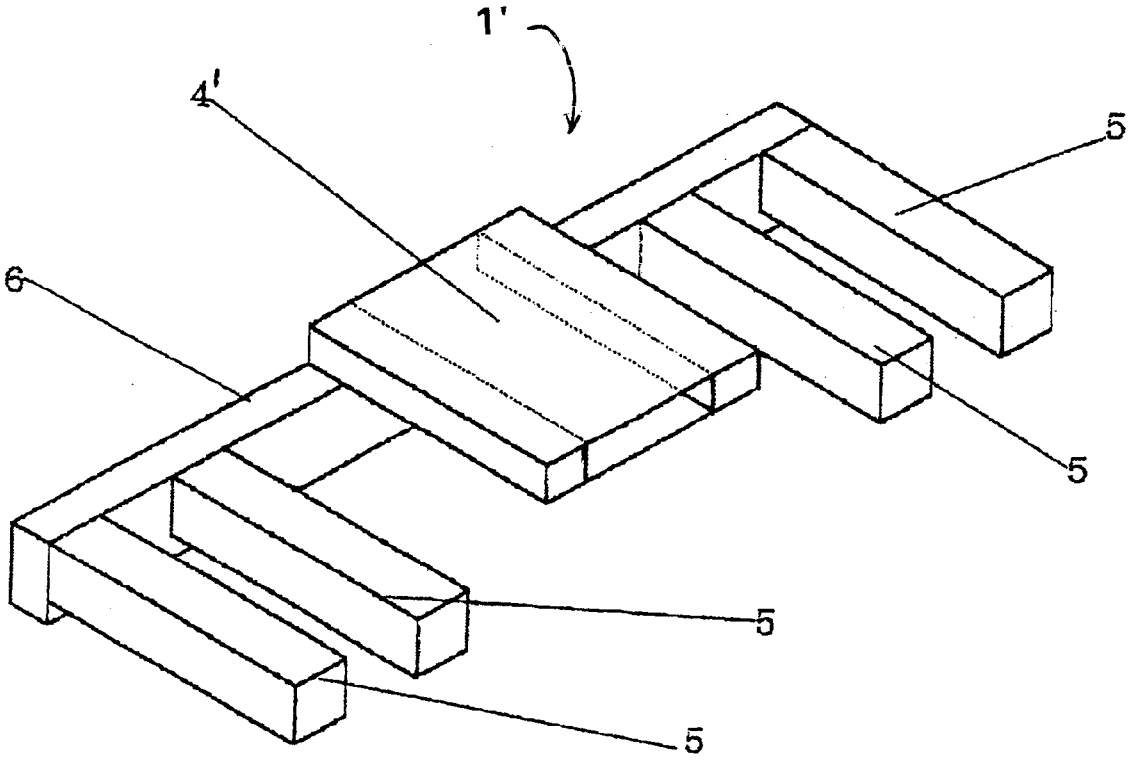
FIG. 2 is perspective view showing a second embodiment of the present invention.

As additionally shown in FIG. 2, a second embodiment of pushing device 1', includes a central body box 4', formed as a rigid cavity having four walls and a front side and a rear side. Body box 4' includes a left, a right, a top and a bottom surface all formed from a rigid material. The front and rear sides of body boxes 4, 4 are formed to allow access to an interior of each body box 4. Body box 4' is shaped to receive and secure forks 2*a*, 2*a* (not shown) as will be explained. Between the left surface and the right surface of body box 4' are formed two internal partitions(not shown) extending from the front side to the rear side of body box 4'. The two partitions divide body box 4' into three cavities, each cavity having a front side, a rear side, a left side and a right side. The two partitions provide guidance to forks 2*a*, 2*a*, (not shown) and assist to secure forks 2*a*, 2*a* (not shown), within body box 4', as will be explained.

In the second embodiment, horizontal board 6 extends parallel to the bottom surface of body box 4'. Horizontal board 6 is affixed to body box 4' and extends away from both the left and the right surfaces of body box 4'. Body box 4 is positioned to receive forks 2*a* (not shown) extending from fork lift 2(not shown) thereby enabling control of horizontal board 6.

In the second embodiment, body box 4' extends perpendicular to horizontal board 6, and is fixed at a central point along the length of horizontal board 6. Four insertion members 5, extend from horizontal member 6 generally parallel to body box 4'. Insertion members 5 extend from horizontal member 6 and are formed to fit within a fork insertion member 3*a*(not shown), as will be described.

In the second embodiment, body box 4' may alternatively include at least single partition(not shown), extending from the front side to the rear side of body box 4', and positioned between the left and right surfaces. Both the single partition (not shown) and the double partitions(not shown) serve to strengthen body box 4' and to guide forks 2*a*, 2*a* (not shown), during operational use.

Figure 3:
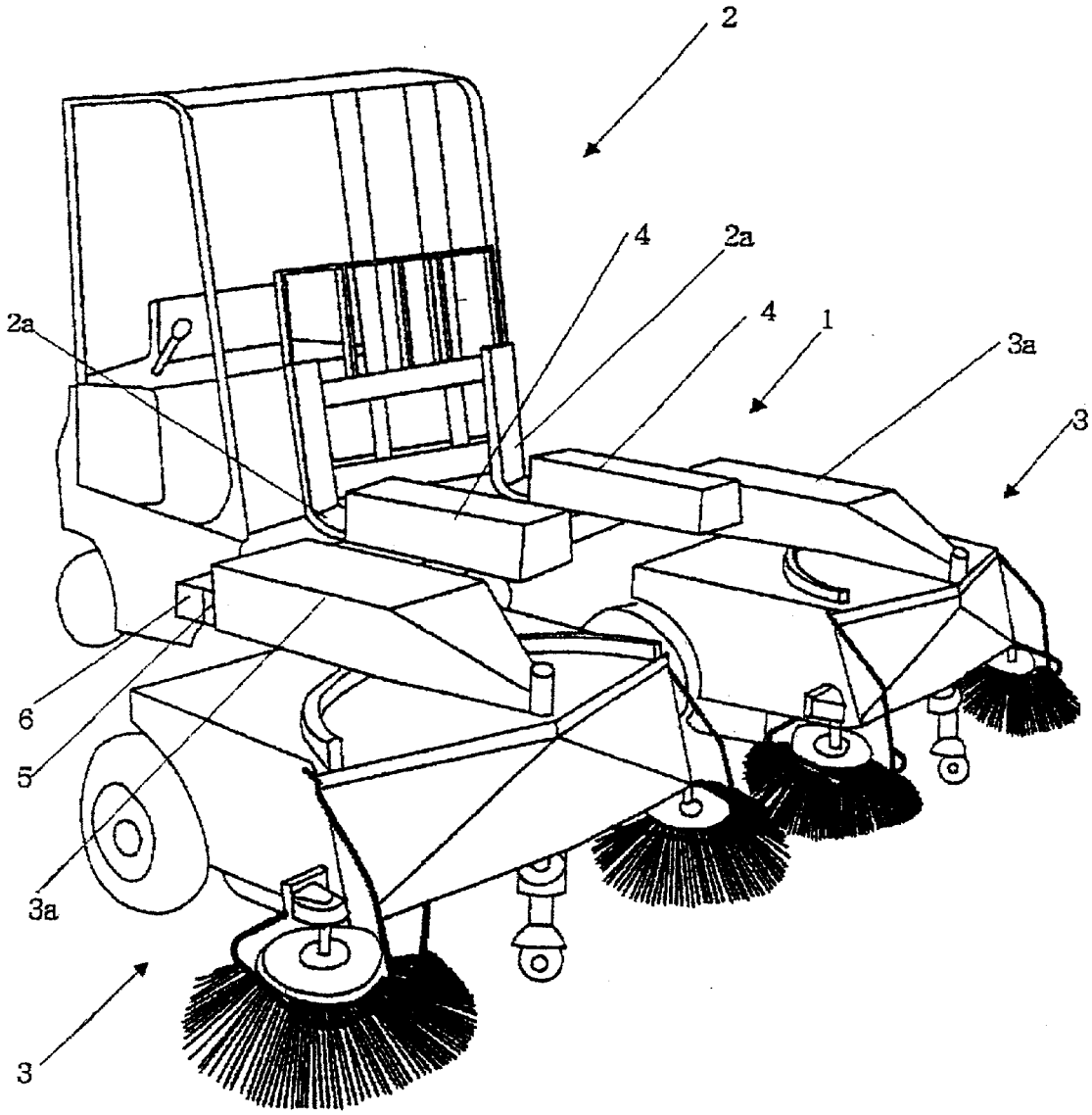
FIG. 3 is a perspective view showing the first embodiment as used.
Figure 4:
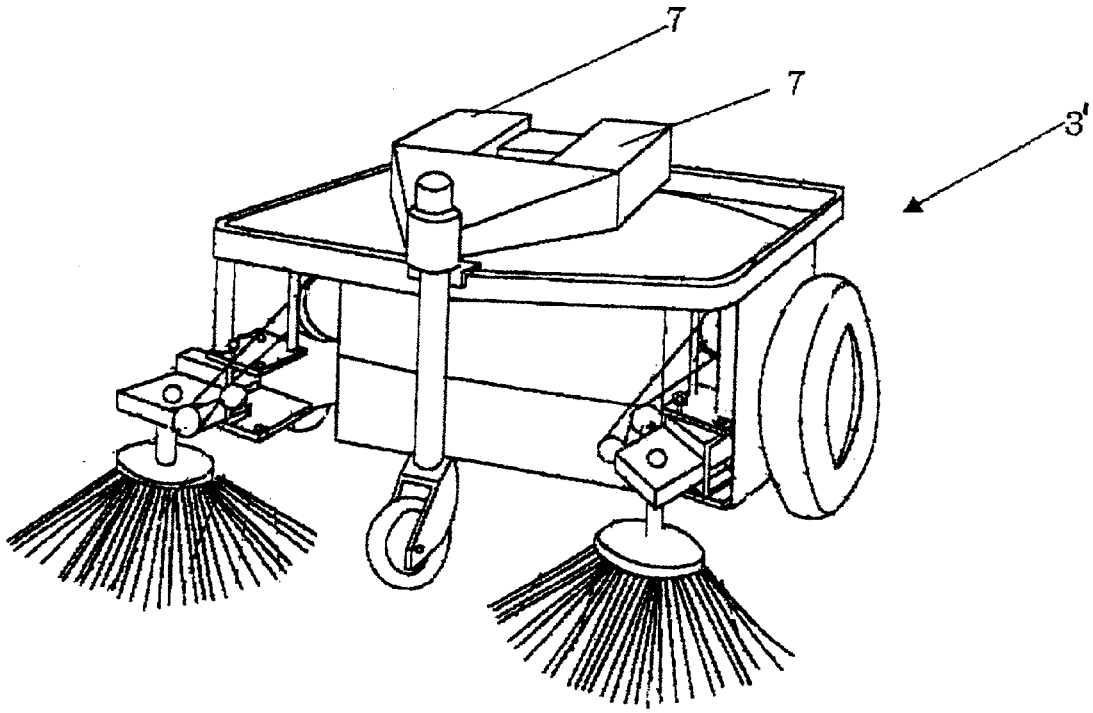
Fig. 4 PRIOR ART
FIG. 4 is a perspective view of a conventional large sweeper.
Figure 5:
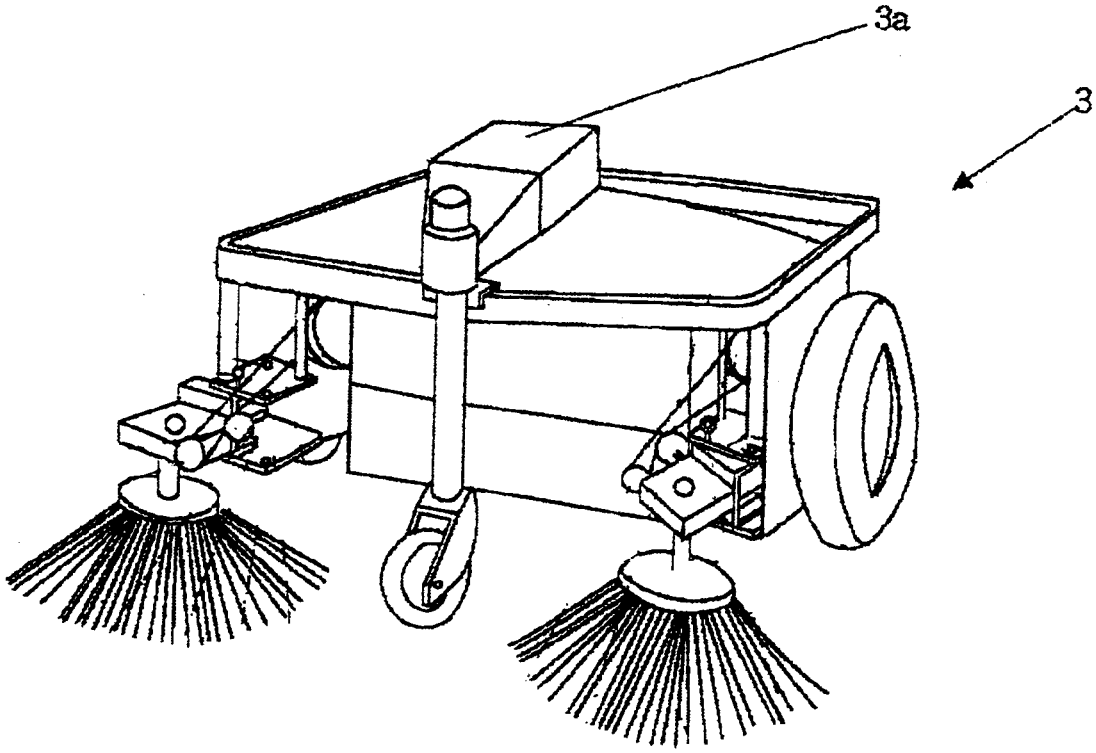
Fig. 5 PRIOR ART
FIG. 5 is a perspective view of another conventional large sweeper.

Additionally referring to FIG. 3, a conventional fork lift 2 is equipped with a motor(not shown) and control systems (not shown) to provide both movement and control to pushing device 1. Fork lift 2 includes two forks 2*a*, 2*a* extending from a frame of fork lift 2. Forks 2*a*,2*a* are adjustable relative to the frame for alignment to respective pushing devices 1, 1'. Here, body boxes 4,4, of pushing device 1 surround respective forks 2*a*, 2*a* through the rear side to affix pushing device 1 to fork lift 2. A large sweeper 3 includes one fork insertion member 3*a* rotatively affixed on a top surface for controlling and guiding large sweeper 3.

Two large sweepers 3, 3, are positioned in front of fork lift 2 to enable fork insertion members 3*a*, 3*a* to receive respective insertion members 5, 5, rigidly affixed to and extending away from horizontal board 6.

As a result, fork lift 2, is connected to large sweepers 3, 3 through rigid pushing device 1. Since fork lift 2 is equipped to provide both movement and control to pushing device 1, fork lift 2 also provides movement and control to large sweepers 3, 3 by transmitting moving and controlling force from body boxes 4, 4 through horizontal board 6 to insertion members 5, 5.

During operation, an operator of fork lift 2, inserts forks 2*a*, 2*a* into either embodiment of pushing devices 1, 1', with body boxes 4,4', through the corresponding rear openings. A top surface of forks 2*a*, 2*a* contacts an inside top surface of body box 4,4' to provide lifting contact. A side surface of forks 2*a*, 2*a* contacts the inside left or right surfaces, or the respective interior partitions, of body boxes 4,4', to provide controlling contact. As the Operator lifts forks 2*a*, 2*a*, contacting the inside top surface of body box 4,4', pushing device 1,1' is additionally lifted. As the Operator guides forks 2*a*, 2*a*, contacting the inside left and right surfaces of body box 4,4', pushing devices 1,1 ' are additionally guided.

The Operator, now controlling and guiding forks 2*a*, 2*a* and either embodiment of pushing device 1,1' inserts respective insertion members 5 into corresponding fork insertion members 7, 7, or 3*a*. As the Operator controls and guides forks 2*a*, 2*a*, large sweepers 3, 3', are controlled and guided.

Where necessitated by manufacture or design, pushing devices 1, 1' may be adapted to guide and control multiple large sweepers 3, 3' thus allowing a large area to be sweep in a single fork lift 2 pass. That is, pushing devices 1, 1' may include insertion members 5 sufficient to control and guide two or more sweepers 3, 3'.

During operation of either embodiment of pushing devices 1, 1', having either body boxes 4, 4', the pushing device 1, 1' acts as an interface for interfacing between forks of a fork lift and a sweeper. The pushing device interfaces with fork lift 2 and transmits controlling and guiding force and motion from fork lift 2 to sweepers 3, 3'.

The embodiments offer several positive points.

First, an Operator employing pushing device 1, 1' may control or interface with multiple large sweepers 3 since body boxes 4,4' may provide controlling and guiding contact with a single fork 2*a*. As a result, broad range of pre-existing fork lifts may be employed in controlling and guiding large sweepers 3, 3' thereby expanding customer satisfaction and reducing costs. For example, a pre-existing fork lift having only one fork may be employed since box body will stabilize pushing device 1, 1' despite having only one fork Second, sweeping a wider range of areas is possible, since pushing devices 1,1' may be used to control single or multiple large sweepers 3, 3'. As a result, an Operator may adaptively use single large sweeper 3, 3' to clean a single narrow area and may then connect to additional large'sweepers 3, 3' to clean a wider surface, thus reducing Operator time and customer costs. Additionally, a customer may not need to purchase an additional very-wide large sweeper (not shown) to take the place of multiple large sweepers 3, 3', thereby reducing Operator time and customer costs.

Having described preferred embodiments of the invention with reference to the accompanying, drawings, it is to be understood that the invention is not limited to those precise embodiments, and that various changes and modifications may be effected therein by one skilled in the art without departing from the scope or spirit of the invention as defined in the appended claims.

What is claimed is:

1. An interface member for interfacing forks of a fork lift with a plurality of sweepers, said interface member comprising:

a single and fixed-flat horizontally extending board having first and second vertical flat surfaces and upper and lower horizontal edges extending between and connected to both vertical surfaces;

first and second fixed forward extending spaced apart parallel horizontal insertion elements disposed at right angles to the first surface of the board and extending outward therefrom, one end of each element being secured to the first surface of said board at a corresponding end thereof, each element being fittable into a corresponding fork insertion member provided on an external sweeper; and first and second fixed and spaced apart box elements comprising a bottom surface, said box elements parallel to and disposed between said insertion elements and said bottom surface extending outward from said first-surface of the board, each box element overlying the upper edge of said board and secured thereto, one end of each box element being aligned with said second surface, each box element being positioned to receive a corresponding one of two forks extending from said fork lift, wherein said insertion elements being disposed below said bottom surface of said box elements.

2. The member of claim 1, herein said insertion elements are spaced apart to permit said insertion elements to be fittable into said corresponding fork insertion member provided on first and second sweepers in such manner that the sweepers can operate without mutual interference.

3. The member of claim 1, wherein each box element is an elongated hollow body with two opposite ends, the end secured to said board adapted to receive a fork, the opposite end being covered.

4. The member of claim 1, wherein each box element has an internal partition.

* * * * *